US009867421B2

(12) United States Patent
Teichert et al.

(10) Patent No.: US 9,867,421 B2
(45) Date of Patent: Jan. 16, 2018

(54) DEBRIS INHIBITOR FOR SHOES AND METHODS FOR MAKING SAME

(71) Applicant: TNG Enterprises LLC (patents), Ocean Springs, MS (US)

(72) Inventors: Joseph A. Teichert, Ocean Springs, MS (US); Carl E. Langley, III, Germantown, TN (US); Eddie A. Parker, Tupelo, MS (US)

(73) Assignee: TNG Enterprises LLC, Ocean Springs, MS (US)

( * ) Notice: Subject to any disclaimer, the term of this patent is extended or adjusted under 35 U.S.C. 154(b) by 0 days.

(21) Appl. No.: 14/666,170

(22) Filed: Mar. 23, 2015

(65) Prior Publication Data

US 2015/0189940 A1 Jul. 9, 2015

Related U.S. Application Data

(63) Continuation-in-part of application No. 13/089,055, filed on Apr. 18, 2011, now Pat. No. 8,984,694.

(60) Provisional application No. 61/325,086, filed on Apr. 16, 2010.

(51) Int. Cl.

| | |
|---|---|
| ***A43B 3/16*** | (2006.01) |
| ***A43B 5/00*** | (2006.01) |
| ***A43B 3/20*** | (2006.01) |
| ***A43B 5/18*** | (2006.01) |

(52) U.S. Cl.

CPC ..... *A43B 3/166* (2013.01); *A43B 3/16* (2013.01); *A43B 3/20* (2013.01); *A43B 5/00* (2013.01); *A43B 5/18* (2013.01)

(58) Field of Classification Search

CPC .. A43B 3/166; A43B 3/16; A43B 3/20; A43B 5/00; A43B 5/18

See application file for complete search history.

(56) References Cited

U.S. PATENT DOCUMENTS

| | | | | | |
|---|---|---|---|---|---|
| 1,622,639 | A * | 3/1927 | Gilbert | A41D 17/00 | 36/2 R |
| 1,648,018 | A * | 11/1927 | Karger | A41D 17/00 | 36/2 R |
| 1,786,862 | A * | 12/1930 | Mouthe | D04B 1/26 | 66/178 R |
| 2,171,654 | A * | 9/1939 | Hinchliff | A43B 3/20 | 36/10 |
| 3,416,518 | A * | 12/1968 | Samuels | A61F 15/004 | 2/16 |
| 4,961,418 | A * | 10/1990 | McLaurin-Smith | A61F 13/06 | 2/164 |
| 6,129,695 | A * | 10/2000 | Peters | A41D 13/05 | 602/61 |
| 6,371,933 | B1 * | 4/2002 | Gardon-Mollard | A61F 13/08 | 2/239 |
| 6,418,561 | B1 * | 7/2002 | Gregory | A41D 13/08 | 2/162 |
| 6,449,772 | B1 * | 9/2002 | Donner | A41D 13/088 | 2/16 |

(Continued)

*Primary Examiner* — Jila M Mohandesi

(74) *Attorney, Agent, or Firm* — Dinsmore & Shohl LLP; Toni-Junell Herbert; Therese M. Finan

(57) ABSTRACT

The invention provides debris inhibitors and inhibitor systems and methods of making same. The inhibitors and inhibitor systems of the present invention are worn over athletic or outdoor shoes to inhibit entry of debris into the athletic or outdoor shoes.

10 Claims, 15 Drawing Sheets

(56) References Cited

U.S. PATENT DOCUMENTS

| | | | | |
|---|---|---|---|---|
| 7,200,870 | B1 * | 4/2007 | Kolk | A41D 13/08 2/16 |
| 7,200,872 | B2 * | 4/2007 | Gregory | A41D 13/088 2/162 |
| 7,383,646 | B2 * | 6/2008 | Hall | A43B 3/0078 36/7.1 R |

* cited by examiner

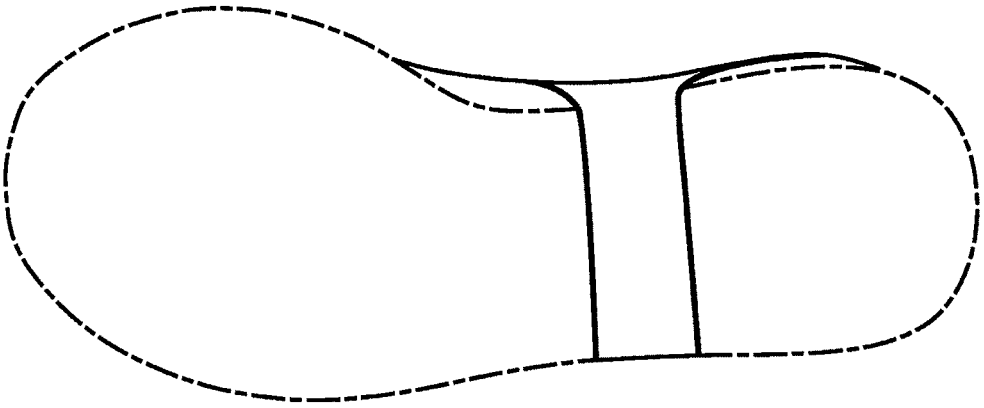
FIG. 11
FIG. 12
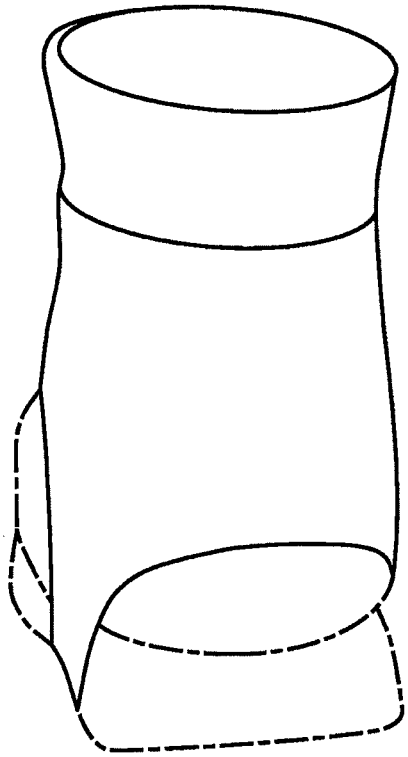

DEBRIS INHIBITOR FOR SHOES AND METHODS FOR MAKING SAME

CROSS REFERENCE TO RELATED APPLICATIONS

This application claims priority to U.S. patent application Ser. No. 13/089,055, filed Apr. 8, 2011, published Oct. 20, 2011 as U.S. Publication No. 20110252581, and U.S. Provisional Patent Application No. 61/325,086, filed Apr. 16, 2010, the entire disclosure of each of which is incorporated by reference herein in its entirety.

FIELD OF INVENTION

The present invention relates to methods of manufacturing debris inhibitors for shoe, including athletic and outdoor shoes.

BACKGROUND OF THE INVENTION

Athletes, such as football, lacrosse, softball, baseball and field hockey players, play on large surface fields that are most often found in outdoor settings. Traditionally, these fields were comprised of natural grass surfaces. In the past several decades, artificial surfaces have been implemented to replace the traditional grass playing surfaces. The artificial turf surfaces have raised many concerns regarding injuries to the lower extremities, e.g., the legs, knees, ankles and toes. These artificial surfaces do not accommodate for contact between the player's body and the ground as would be found in natural surfaces.

Advances in artificial turf playing surfaces have been made to address some of these issues. For example, some artificial fields now employ "crumb rubber" and other types of filler that is spread over the field to simulate natural surfaces both aesthetically and functionally. These fillers tend to get into players' shoes and can create abrasions with the concomitant risk of infections.

During games and practices, players can get these fillers in their shoes. Once in the shoes, these fillers can cause injuries to the foot and the toes, such as blisters, torn skin, and damage to the toe nails. These types of breaches in the skin and nails can expose the players to potential infections from the life threatening microorganisms. Moreover, these fillers can cause structural injuries to the players, such as aggravating turf toe injuries, causing bone bruising and instability during play.

Products are needed that can effectively inhibit entry of these field fillers and other objects from getting into the players' shoes. Ideally, these products would cover the shoe in a protective manner as to cover the entry points of the shoe that could permit passage of debris from the playing surface into the shoe. The inventors have developed such a product that inhibits playing field debris from entering the shoes and exposing the players to health risks such as physical injury and unneeded exposure to potentially infectious microorganisms.

SUMMARY OF THE INVENTION

The present invention provides methods for manufacturing an over-the-shoe debris inhibitor from a tubular woven material. The tubular woven material is initially cut at a length sufficient enough to provide a debris inhibitor of desired length.

In one embodiment, initial raw cuts provide enough material to form hem lines at each end of the debris inhibitor. The hem lines are formed by folding and stitching the material to form bands at each end that serve as openings for the debris inhibitor.

Along a side length of the debris inhibitor, at least one straight cut is made perpendicular to the length of the material that is at a desired depth. The desired length is less than the circumference of the tubular woven material. The straight cut provides unexpected characteristics regarding manufacturing and functionality of the debris inhibitor. The straight cut is at a desired depth and provide openings or passages for cleats from an athletic shoe.

The straight cut provides for conformity of the debris inhibitor to an athletic shoe, e.g., cleated athletic shoe. The straight cut also provides for passage and conformity to a heel of the shoe and cleats to aid in inhibiting debris from entering the athletic shoe.

An embodiment of the invention is a method is manufacturing an over-the-shoe debris inhibitor from a tubular woven material comprising cutting a desired length of tubular woven material thereby forming a first raw cut and a second raw cut, wherein each raw cut is at opposite ends of the length of tubular woven material. The material is a fabric that can stretch. In embodiments at least one straight cut is made proximal to the first raw cut. In other embodiments at least one straight cut is made proximal to the second raw cut. The straight cut is at a depth less than the circumference of the tubular woven material. In an embodiment of the invention, the straight cut forms an opening for passage of and conformity of cleats located on the bottom of the shoe. In embodiments, the straight cut forms an opening for passage of and conformity to a heel of the shoe and cleats located on the heel of the shoe. In some embodiments, cleats are located at or near the front of the shoe. The straight cut keeps the debris inhibitor from stretching above a top portion of a back portion of the shoe. The method of manufacture produces an over-the-shoe debris inhibitor that covers an outside area of the shoe in use and inhibits debris from entering openings of the shoe.

In another embodiment of the present invention, a method is provided for manufacturing an over-the-shoe debris inhibitor from a tubular woven material that results in a debris inhibitor with a stirrup design.

This method comprises, in part, making two raw cuts of the tubular woven material to a desired length. A band of desired width or thickness is formed at the location of the first raw cut by folding the first raw cut material and stitching a hem line. Also, a stirrup is formed in the direction of the second raw cut by making two shaped cuts. The two shaped cuts are made so that two sides of a stirrup are formed, wherein the two sides to the stirrup are stitched together at the ends to complete the stirrup. The angles of the two shaped cuts provide unexpected characteristics that provide conformity to the athletic shoe and aid in the stability and inhibitory aspects of the debris inhibitor.

In another embodiment of the present invention, an inhibitor system is provided comprising a sock/inhibitor combination, wherein a sock of desired material is attached to the internal side of the inhibitor.

BRIEF DESCRIPTION OF THE DRAWINGS

FIG. 11 is an angled bottom-to-top view of a debris inhibitor of the present invention while in use with an athletic shoe.

FIG. 12 is an angled back-to-front view of a debris inhibitor of the present invention while in use with an athletic shoe.

DETAIL DESCRIPTION OF THE INVENTION

The material used in the present invention can be any material capable of multi-directional stretch. The material should be capable of being formed into a seamless tube via machine weaving. The machine woven material tube is formed prior to the cutting.

In a preferred embodiment, the material is formed from a ply nylon and elastic combination. As an example, the ply nylon can be a two-ply or a three-ply nylon. Furthermore, the ply nylon and elastic material should be in a ratio that permits the desired multi-directional stretch necessary for the invention. The ratio of ply nylon to elastic is in the range of about 50% to about 50%; about 60% to about 40%; about 70% to about 30%; about 80% to about 20%; about 90% to about 10%; about 95% to about 5%; and about 97% to about 3%, respectively.

It will be appreciated by those of skill in the art that other materials are encompassed that allow for the multi-directional stretch of the present invention. Without limitation, these materials encompass such other materials as polyesters and elastane, for example. It will also be appreciated by those of skill in the art that materials within the scope of the present invention may also include antimicrobial and moisture wicking characteristics, for example.

Inhibitor for Use with Cleated Shoes

Figure 1A:
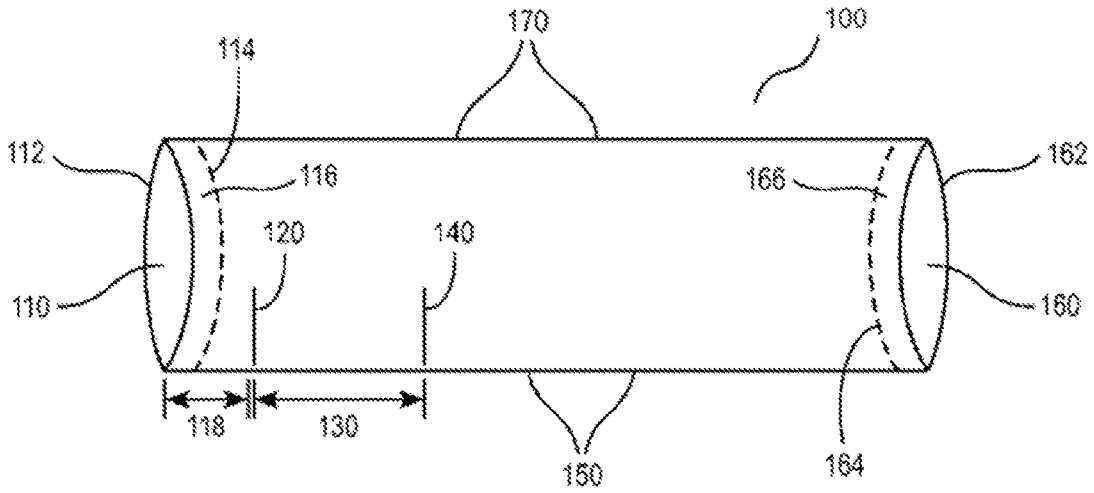
FIGS. 1A-1B show a debris inhibitor of the present invention.
Figure 1B:
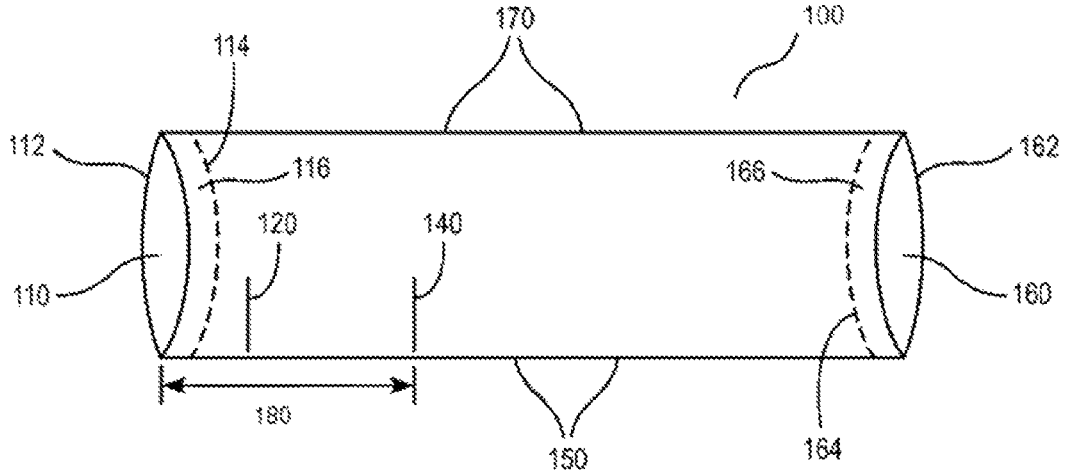

The inhibitor 100, as seen in FIGS. 1A and 1B, is a woven tube of material as described herein. Inhibitor 100 is constructed to accommodate a cleated athletic shoe, and inhibitor 100 is an over-the-shoe product for inhibiting debris from entering the shoe while in use. The circumference of inhibitor 100 can vary depending on the size and type of athletic shoe.

The cleated athletic shoe is inserted through ankle-opening 160. Toe-opening 110 permits the toe portion of an athletic shoe to pass through the inhibitor. Bottom portion 118, bottom portion 130, and bottom portion 180 are proportioned to accommodate the spacing of cleats on the athletic shoe, wherein bottom portions 118 and 130, and bottom portion 180, fit between the cleats without impeding the purpose of the cleats while in use. Cut 120 and cut 140 are proportioned to permit the cleats to project through the inhibitor. Portion 170 covers the top of the cleated athletic shoe. Portion 150 covers from the lower area of the back heel of the cleated athletic shoe upward to ankle-opening 160. Ankle-opening 160 is meant to mate in a secured or tight fitting fashion with the area around the wearer's leg just above the top of the cleated athletic shoe.

Toe-band 116 and ankle-band 166 represent the opposite ends of the completed product. Hem-line 114 and hem-line 164 are the result of the cutting, folding and stitching of the further most toe cut and the further most ankle cut of the tube material. When the tube material is cut at the toe portion, the cut end is folded back into the inner side of inhibitor 100. Once folded into the inner side of inhibitor 100, hem-line 114 is created by stitching the folded in portion to the inner side of inhibitor 100. Once hem-line 114 is stitched, toe-band 116 is formed. Toe-band 116 may comprise additional material within the fold; e.g., elastic, which forms additional stability to toe-band 116. Width of toe-band 116 and placement of hem-line 114 may vary based on the type and size of athletic shoe, and may also vary based on the cleat placements on the athletic shoe.

When the tube material is cut at ankle-opening 160, the cut end is folded back into the inner side of inhibitor 100. Once folded into the inner side of inhibitor 100, hem-line 164 is created by stitching the folded in portion to the inner side of inhibitor 100. Once hem-line 164 is stitched, ankle-band 166 is formed. Ankle-band 166 may comprise additional material within the fold; e.g., elastic, which forms additional stability to ankle-band 166.

Toe-end 112 and ankle-end 162 serve as the end portions of the completed product after toe-band 114 and ankle-band 164 are formed by stitching hem-line 114 and hem-line 164.

The process of cutting the tube material to form the desired length of inhibitor 100 requires multiple cuts at strategic locations along the tube material. First, the tube material is cut to form a raw cut across the full circumference of the tube material at the toe end and the ankle end. The raw cuts at each end are subsequently folded into the inner portion of inhibitor 100 and hemmed to form hem-lines 114 and 164. Once the raw cuts are hemmed, toe-band 116 and ankle-band 166 are formed, and comprise a doubled layer of tube material due to the folding inward and hemming to the inner portions of inhibitor 100. The size of toe-band 116 and ankle-band 166 will depend in part on the size of inhibitor 100 that is desired.

The raw cut that is folded into the inner surface of inhibitor 100 to form ankle-band 166 can vary in regard to the distance between ankle-opening 160 and hem-line 164. Again, this distance between these two reference points will depend on the size of the overall inhibitor 100 size. Alternatively, this distance may depend on the type of athletic cleat, e.g., low-, mid-, and high-top cleated shoes.

The raw cut at the toe is folded back into the inner area of inhibitor 100 to form toe-band 116. Toe-band 116 can be any desired length as measured from toe-end 112 to hem-line 114. The length, however, should be hemmed between toe-end 112 and cut 120 in FIG. 1A, or between toe-end 112 and cut 140 in FIG. 1B. The length of toe-band 116 should be in a range of about ¼" to about 1". In one embodiment, toe-band 116 is formed by folding the raw cut into the inner area of inhibitor 100 and hemmed to form a toe-band 116 length of about ⅜" once hem-line 114 is created. Therefore, toe-band 116 will comprise two layers of tube material by the folding and hemming process as described herein. The distance between hem-line 114 and cut 120 in FIG. 1A, or between toe-end 112 and cut 140 in FIG. 1B can be in the range of about ⅛" to about ¾". In one embodiment, the distance between hem-line 114 and cut 120 in FIG. 1A, or between toe-end 112 and cut 140 in FIG. 1B, is about ½.

In an embodiment of the invention, cut 120 is a straight cut that is perpendicular to bottom portion 118, bottom portion 130 and portion 150 in the tube material that forms inhibitor 100. The depth of cut 120 will vary depending on the type of cleated shoe. The depth of cut 120 can be in the range of about ¾" to about 1¼". In one embodiment, cut 120 is made to a depth of about 1".

In an embodiment, cut 140 is a straight cut that is perpendicular to bottom portion 118, bottom portion 130, and portion 150 in the tube material that forms inhibitor 100 (FIG. 1A). The depth of cut 140 will vary depending on the type of cleated shoe. The depth of cut 140 can be in the range of about ¾" to about 1¼". In one embodiment, cut 140 is made to a depth of about 1".

In an alternative embodiment, cut 140 is a straight cut that is perpendicular to bottom portion 180 and portion 150 in the tube material that forms inhibitor 100 (FIG. 1B). The depth of cut 140 will vary depending on the type of cleated shoe. The depth of cut 140 can be in the range of about ¾" to about 1¼". In one embodiment, cut 140 is made to a depth of about 1".

Cut 120 and cut 140 are straight cuts as described herein. The straight cut is necessary; when a cut other than a straight cut is made, the tube material presents in a waived and uneven manner. Without the straight cut, inhibitor 100 presents certain manufacturing difficulties when the material is shored up with stitching along the cut to prevent tearing or fraying of the tube material. Several approaches were attempted to make cut 120 and cut 140; however, the non-straight cuts resulted in a wavy and uneven appearance that did not permit the opening created by each cut to conform to the cleat pattern of the athletic shoe. Cut 120 and cut 140 are also necessary because the straight cuts in inhibitor 100 prevent the stretch or pulling up of inhibitor 100 to an area above the top of the shoe where it would be ineffective in inhibiting debris from entering the cleated shoe, especially regarding cut 140. Additionally, cut 120 and cut 140 reduces manufacturing cost with the straight cut rather than alternative more complicated and costly cut patterns.

Once the material is weaved into tube form, the tube can be cut to any desired length. For example, the tubed material can be cut for lengths of sizes for small, medium, large and extra-large. The cut lengths, related to sizes, can be based on any equations used in the industry for sizing apparel for different age groups and sexes in athletics, for example. Only as an example and not intended as a limitation, inhibitor 100 lengths for the sizes of small, medium, large and extra-large for average sizes can be 8", 10", 12", and 14".

The cuts necessary to form inhibitor 100 as defined in the invention will vary based in part on the type of shoe, age and sex of the athlete, and the materials to be employed in the manufacture. By example only and not intended as a limitation on the present invention, the following patterns are provided as guidance in the manufacture of inhibitor 100. All measurements are based on either the raw cut at the toe portion of inhibitor 100 or toe-end 112.

The raw cut at the toe of inhibitor 100 is made as described herein. Toe-band 116 is formed and characterized as described herein. Cut 120 is formed and characterized as described herein. Examples of inhibitor 100 are provided in Table 1, wherein toe-band 116, ankle-band 166 and cut 120 are as described above. In Table 1, cut 140 is formed and characterized as described herein, and may also have the following patterns (Table 1) as relates to some of the sizes available through the present invention.

TABLE 1

Pattern for Inhibitor 100 with Cut 140

| Size | Distance of Cut 140 from raw cut at Toe (prior to folding and hemming) | Distance of Cut 140 from Toe-end 112 (after folding and hemming) |
|---|---|---|
| Small | 3¼" | 2½" |
| Medium | 3¼" | 2½" |
| Large | 3¾" | 3" |
| Extra-Large | 4¼" | 3½" |

In an embodiment, cut 120 and cut 140 are made by a straight cut that is perpendicular to bottom portion 118, bottom portion 130, and portion 150. In another embodiment, cut 140 is made by a straight cut that is perpendicular to bottom portion 180 and portion 150. Once the straight cut is made to the desired depth as described above, the tube material is stitched along the edges of the cut to stabilize the tube material along the edges of the straight cut. As discussed above, it is the straight cut pattern of cut 120, and cut 140 that provides the unexpected ability to prevent the tube material from presenting in a waived and uneven manner.

Figure 2:
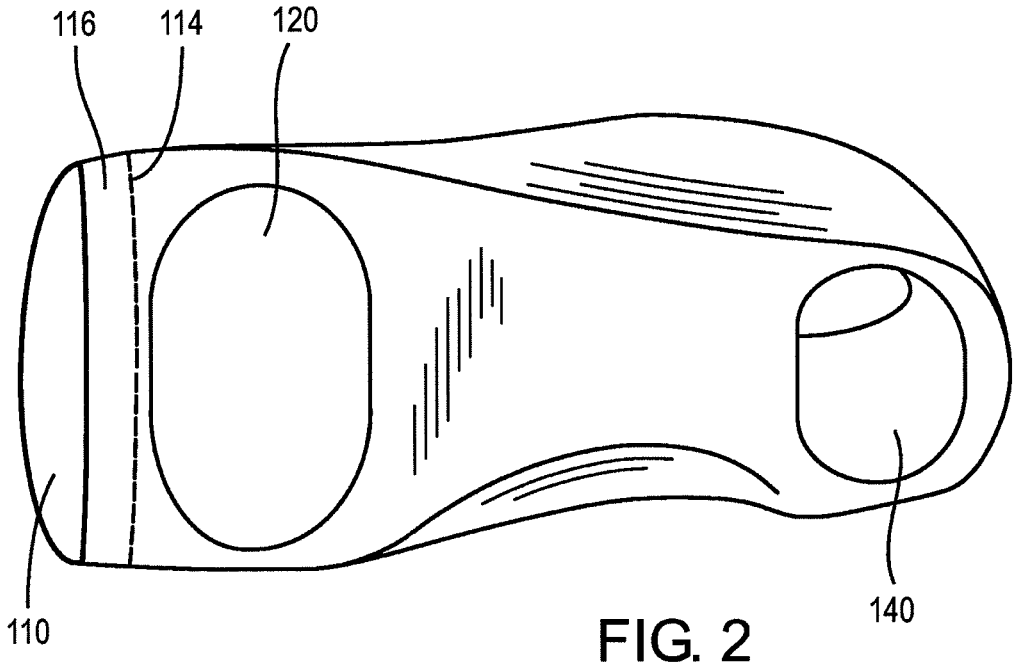
FIG. 2 shows an angled, bottom-to-top view of an expanded debris inhibitor of the present invention.
Figure 3:
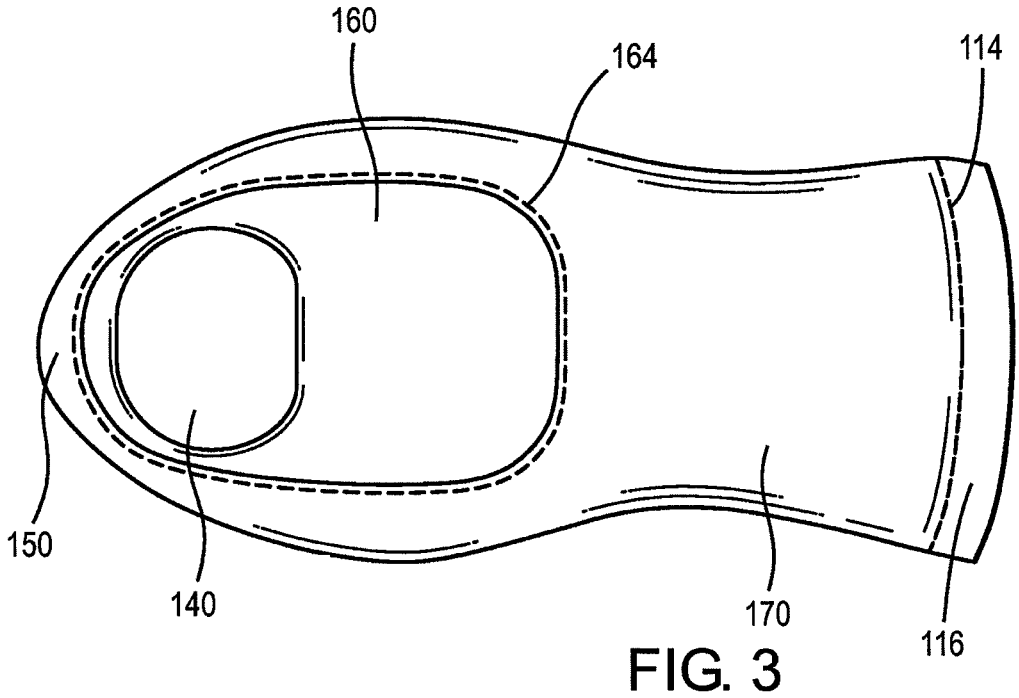
FIG. 3 shows a top-to-bottom view of an expanded debris inhibitor of the present invention.
Figure 4:
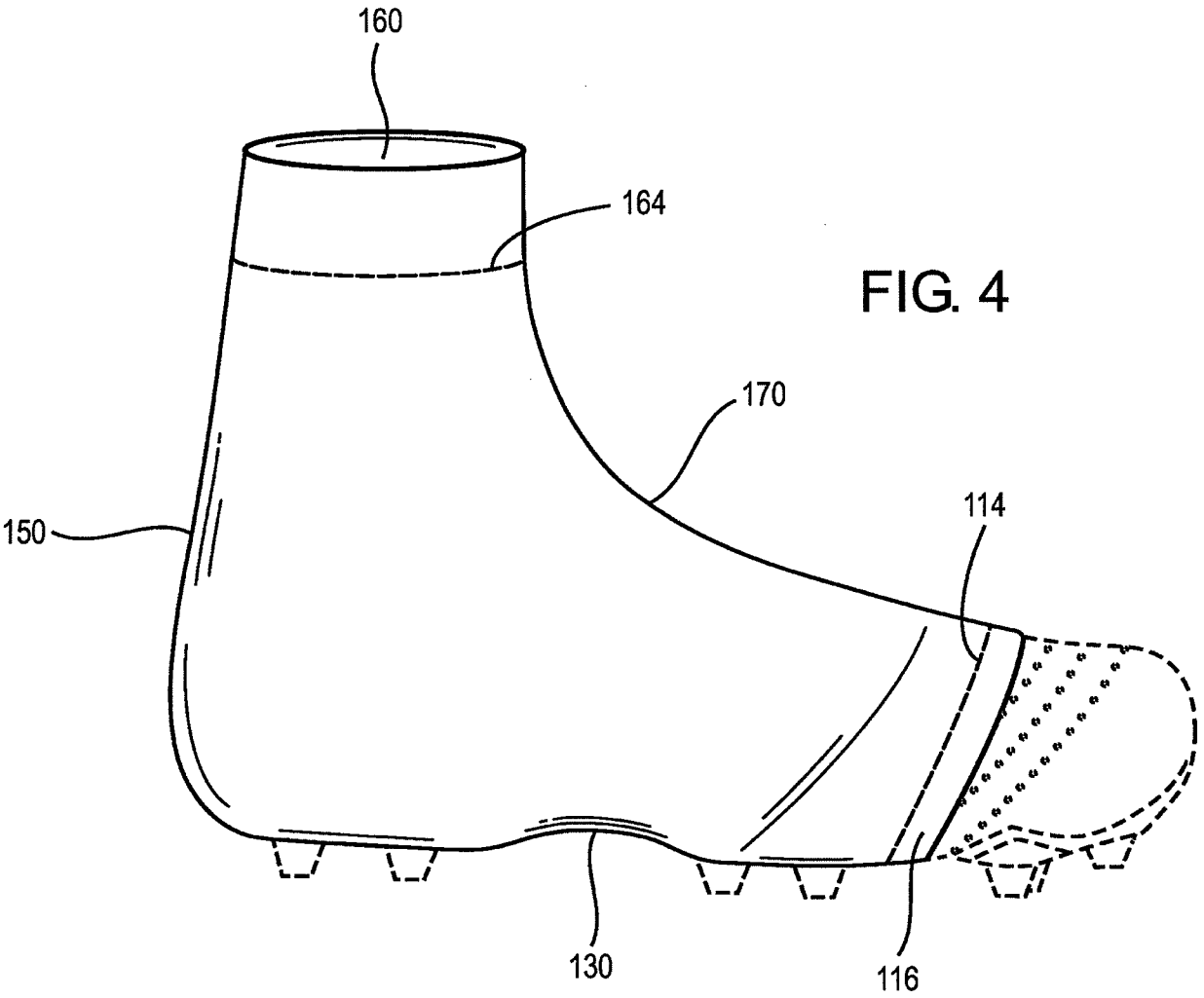
FIG. 4 shows a side view of a debris inhibitor of the present invention while in use with a cleated athletic shoe.
Figure 5:
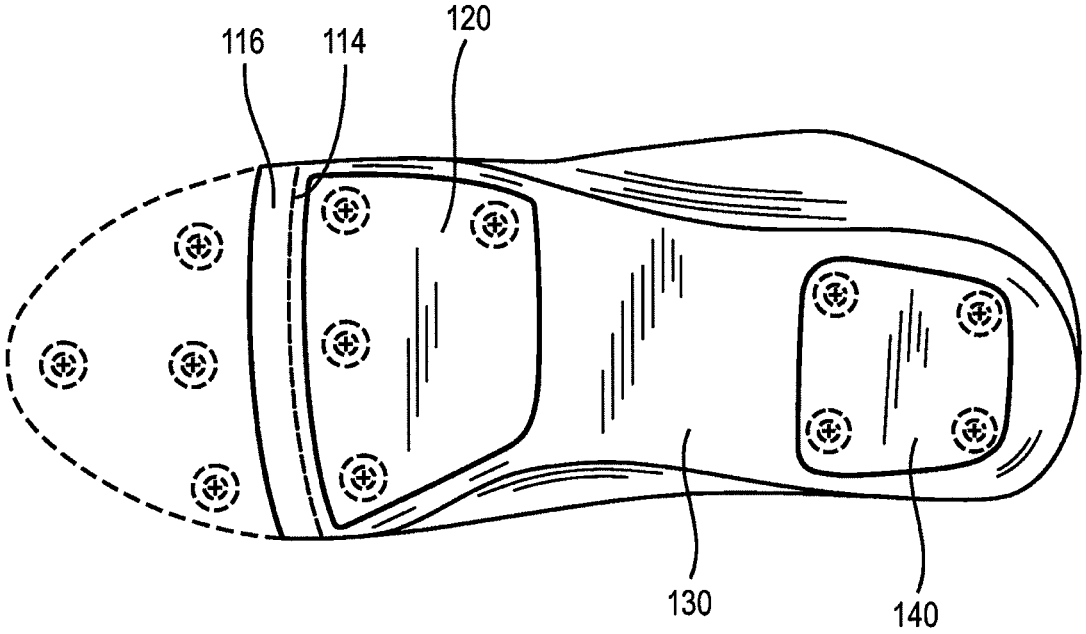
FIG. 5 shows an angled, bottom-to-top view of a debris inhibitor of the present invention in use with a cleated athletic shoe.

FIGS. 2-3 show inhibitor 100 in expanded form to illustrate one embodiment of the present invention. While no athletic shoe is shown, FIGS. 2-3 show one aspect of how inhibitor 100 would conform to an athletic shoe. FIGS. 4-5 illustrate inhibitor 100 in use on a cleated athletic shoe.

FIG. 4 provides an in use side view showing cleats passing through cuts 120 and 140. FIG. 2 illustrates how cuts 120 and 140 in inhibitor 100 expand to accommodate bottom portions of the athletic shoe. This accommodating expansion is further illustrated in FIG. 5, wherein cuts 120 and 140 expand to conform to the positioning of cleats on an athletic shoe.

Figure 17:
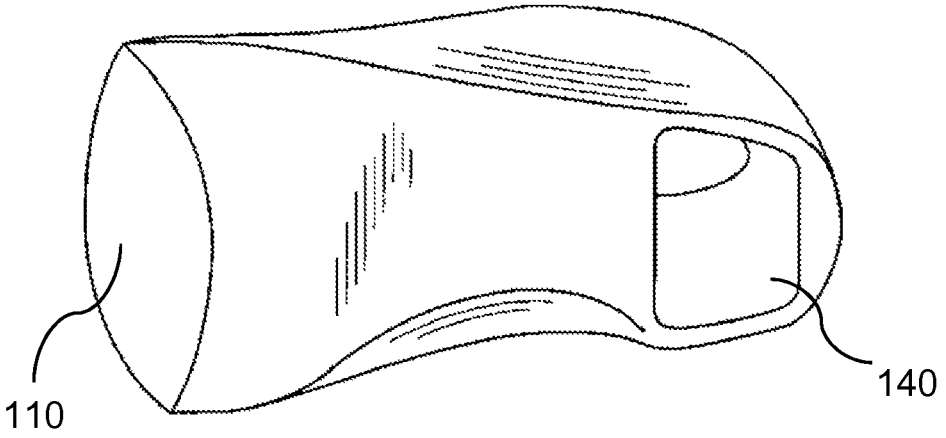
FIG. 17 shows an angled, bottom-to-top view of an expanded debris inhibitor of the present invention.
Figure 18:
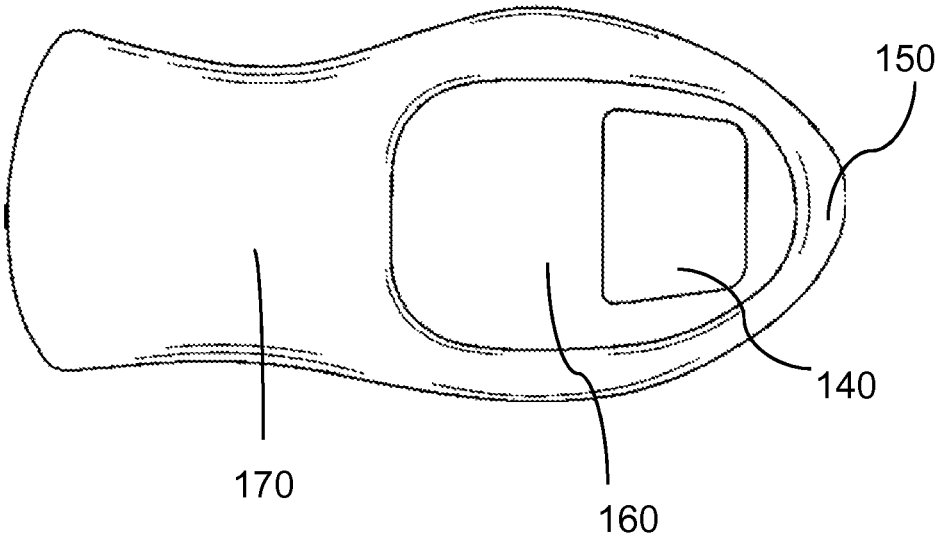
FIG. 18 shows a top-to-bottom view of an expanded debris inhibitor of the present invention.
Figure 19:
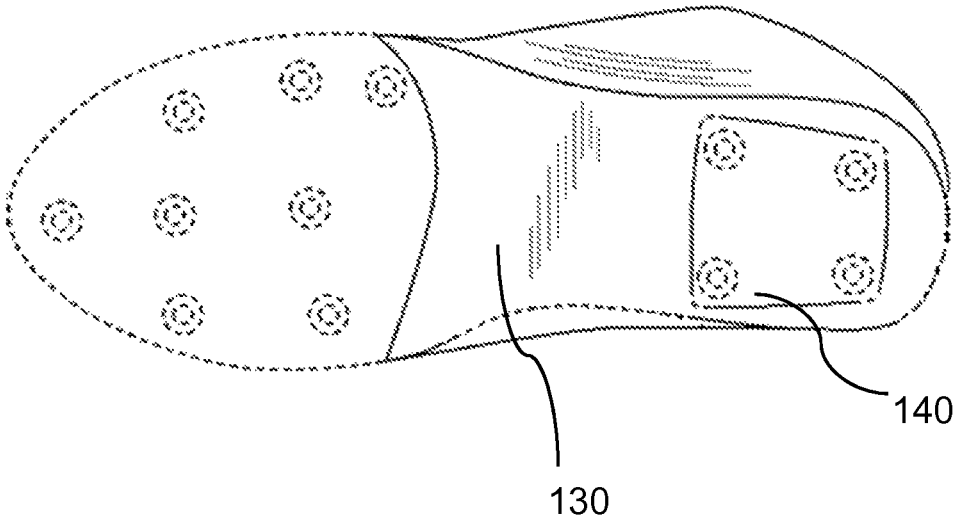
FIG. 19 shows an angled, bottom-to-top view of a debris inhibitor of the present invention in use with a cleated athletic shoe.
Figure 20:
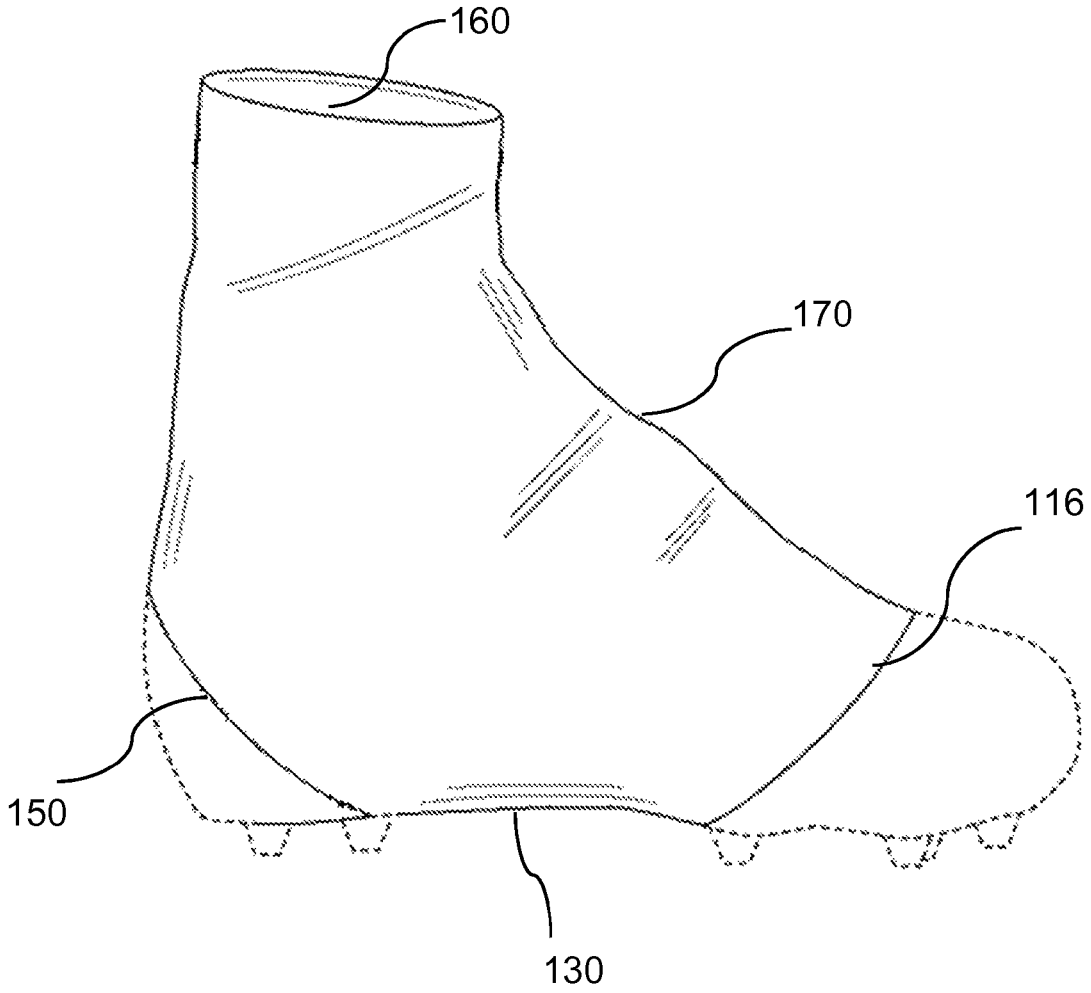
FIG. 20 shows a side view of a debris inhibitor of the present invention while in use with a cleated athletic shoe.

FIGS. 17-20 illustrate another embodiment of the inhibitor 100 of the present invention with one straight cut, cut 140. FIGS. 17-18 show inhibitor 100 in expanded form to illustrate an embodiment of the present invention. While no athletic shoe is shown, FIGS. 17-18 show one aspect of how inhibitor 100 with one straight cut would conform to an athletic shoe. FIGS. 19-20 illustrate inhibitor 100 in use on a cleated athletic shoe.

FIG. 20 provides an in-use side view showing cleats passing through single cut 140. FIG. 17 illustrates how cut 140 in inhibitor 100 in FIG. 1B expands to accommodate bottom portions of the athletic shoe. This accommodating expansion is further illustrated in FIG. 19, where cut 140 expands to conform to the positioning of cleats on an athletic shoe.

Inhibitor with a Stirrup

Figure 6:
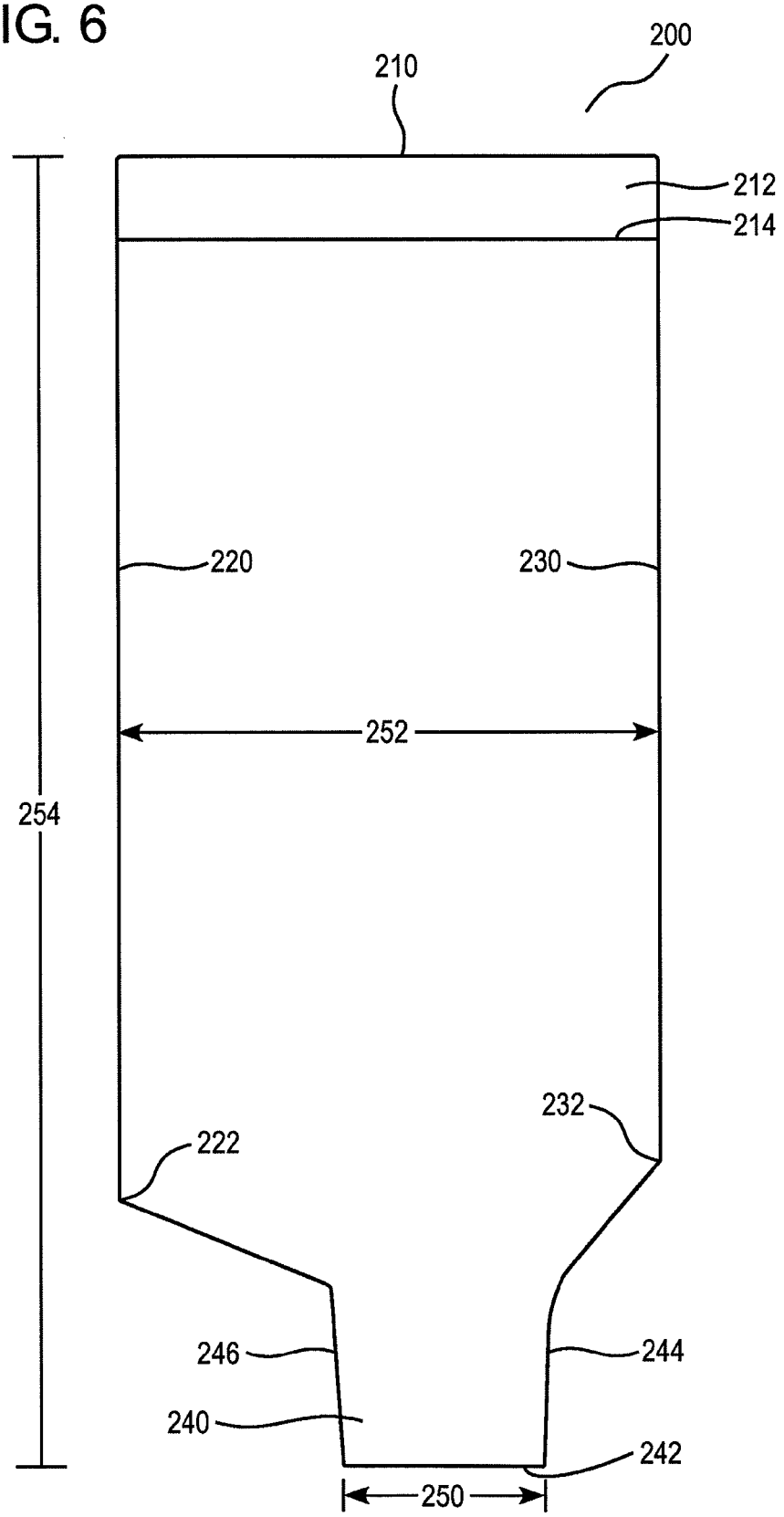
FIG. 6 shows a debris inhibitor of the present invention.

Another embodiment of the present invention is found in FIG. 6. Inhibitor 200 of FIG. 6 is an over-the-shoe product for inhibiting debris from entering the shoe while in use. Inhibitor 200 is a weaved tube of material as described above. The shoe is inserted through ankle-opening 210. Toe-opening 244 permits the toe portion of the shoe to pass through inhibitor 200. Heel-opening 246 permits the heel portion of the shoe to pass through inhibitor 200. Stirrup 240 secures inhibitor 200 around the sides and bottom of the outside of the shoe.

Ankle-band 212 is formed by making a raw cut on the tube material at one end. The raw cut is folded back into the inner surface of inhibitor 200 and hemmed to the inside surface, thereby forming hem-line 214. The distance from ankle-opening 210 to hem-line 214 can be any distance desired to accommodate a particular shoe type and size. In certain embodiments, ankle-band 212 can have a thickness from about ½ to about ¾"; however, this aspect can be adjusted as desired. Ankle-band 212 can comprise additional materials (e.g., elastic) that provide additional stability to ankle-band 212. Such material would be inside the space created by the folding and stitching to form ankle-band 212. Ankle-band 212 is designed to provide secure attachment to the wearer's leg just above the top portion of the shoe while in use.

Back portion 220 inhibits debris from entering the back of the shoe while in use, and covers the back of the shoe and back of the lower leg above the top of the shoe while in use. Front portion 230 inhibits debris from entering the front of the shoe while in use, and covers the front of the shoe and front of the lower leg above the top of the shoe while in use.

Cut 222 is made at the desired depth and angle toward stirrup 240 to permit passage of the heel of the shoe through inhibitor 200. Cut 222 can be made at a depth of about 2" to about 2½" from back portion 220 toward stirrup 240. In one embodiment, the depth of cut 222 is about 2¼" in back of the tube material. The angle of cut 222 is in a range from about 15° to about 40° off the perpendicular to back portion 220. It will be understood by the skilled artisan that cut 222, and the depth and angle thereof, should be such to accommodate the passage of the heel of a shoe through inhibitor 200 and out heel-opening 246.

Figure 14:
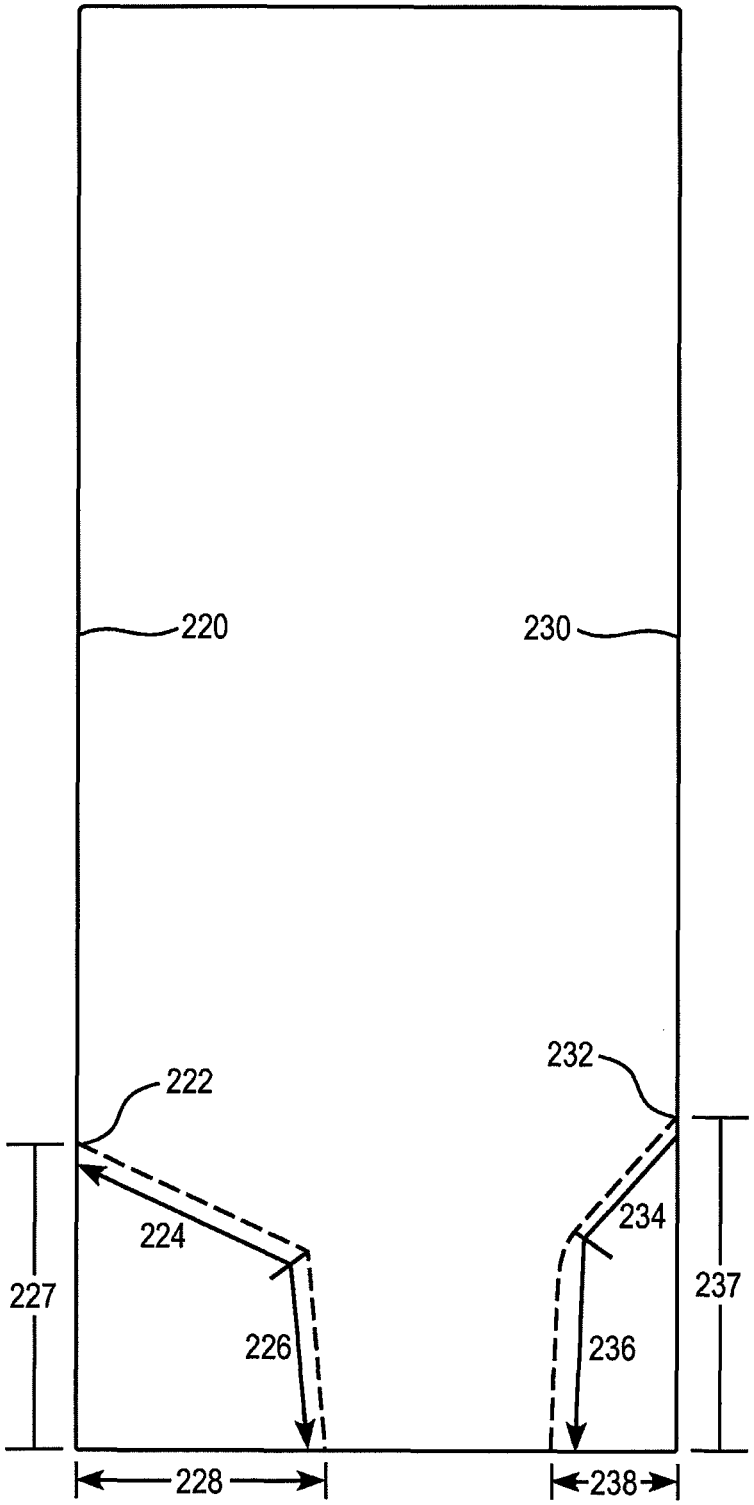
FIG. 14 illustrates a cutting pattern for one embodiment of the present invention.

As seen in FIG. 14, a cut pattern is illustrated for one embodiment of the present invention. Cut 222 is formed by two cuts. Cut 224 is made based on the degree of angles described herein. Also, cut 224 is made in a range from about 1¼" to about 1¾". Cut 226 is made in a range from about 1" to about 1½". In one embodiment, cut 224 is made at about 1½" and cut 226 is made at about 1¼" to form heel-opening 246 of stirrup 240. In one embodiment, heel-opening 246 has a cut height 227. Cut height 227 is in a range from about 1½" to 2"; more specifically a cut height of 2". The depth of heel-opening 246 is represented by cut depth 228. In one embodiment, cut depth 228 is made from about 1½" to about 1⅝"; more specifically a cut depth of 1⅝".

Cut 232 is made at the desired depth and angle toward stirrup 240 to permit passage of the toe of the shoe through inhibitor 200. Cut 232 can be made at a depth of about 1¾" to about 2¼" from front portion 230 toward stirrup 240. In one embodiment, the depth of cut 232 is about 2" in front of the tube material. The angle of cut 232 is in a range from about 25° to about 60° off the perpendicular to front portion 230. It will be understood by the skilled artisan that cut 232, and the depth and angle thereof, should be such to accommodate the passage of the toe of a shoe through inhibitor 200 and out toe-opening 244.

As seen in FIG. 14, a cut pattern is illustrated for one embodiment of the present invention. Cut 232 is formed by two cuts. Cut 234 is made based on the degree of angles described herein. Also, cut 234 is made in a range from about ¾" to about 1". Cut 236 is made in a range from about 1" to about 1¼". In one embodiment, cut 234 is made at about 1" and cut 236 is made at about 1¼ to form toe-opening 244 of stirrup 240. In one embodiment, heel-opening 244 has a cut height 237. Cut height 237 is in a range from about 2" to about 2¼"; more specifically a cut height of 2¼". The depth of toe-opening 244 is represented by cut depth 238. In one embodiment, cut depth 238 is made from about 1" to about 1 1/16"; more specifically a cut depth of 1 1/16".

The cut pattern illustrated in FIG. 14 shows a raw cut prior to formation of ankle-band 212 and forming stirrup 240 by forming seam 242. Therefore, the raw cut length has to be sufficient to form the desired lengths, heights and widths described herein. The measurements of the desired final product will depend, for example, on the thickness of ankle-band 212. These adjustments will be readily appreciated by the skilled artisan. For example, the length of tube material after raw cuts at each end can be from about 10" to about 10½"; more specifically about 10¼".

It will be understood by the skilled artisan that the depths and angles of cut 222 and cut 232 will affect the positioning of stirrup 240. In one embodiment, the depth and angle of cut 222 and cut 232 will be such that stirrup 240 will be positioned toward front portion 230.

Once the desired depths and angles of cut 222 and cut 232 are determined and made, the tube material forming the sides of stirrup 240 are stitched together to form seam 242, which in turn completes the formation of stirrup 240. In one embodiment, seam 242 is made from along a line from back portion 220 to front portion 230 or vice versa.

After cut 222 and cut 232 are made, the edges of each cut are stitched in a manner that provides stability and prevents fraying of inhibitor 200.

As seen in FIG. 6, length 254 represents the overall desired length of inhibitor 200 as defined from ankle-opening 210 to seam 242. Length 254 can be in a range from about 7" to about 10". In one embodiment, length 254 is about 9"; however, length 254 will depend on the desired shoe type and size.

Width 252 represents the overall desired width of inhibitor 200 as defined from front portion 230 to back portion 220. Width 252 can be in a range from about 3¾" to about 5". In one embodiment, width 252 is about 4½"; however, width 252 will depend on the desired shoe type and size.

Width 250 represents the overall desired width of stirrup 240 as defined from front portion 230 to back portion 220. Width 250 can be in a range from about 1½" to about 2½"; however, width 250 will depend on the desired shoe type and size.

In one embodiment, stirrup 240 comprises a slightly forward angular design in toe-opening 244 as compared to heel-opening 246. With the slightly forward angular design in toe-opening 244, stirrup 240 forms an unexpectedly tighter mating with the shoe while in use. The tighter mating aids in preventing inhibitor 200 from moving up the shoe to expose the top of the shoe, thereby permitting debris to enter the shoe while in use. This tighter mating is illustrated in FIGS. 12-13.

Figure 13:
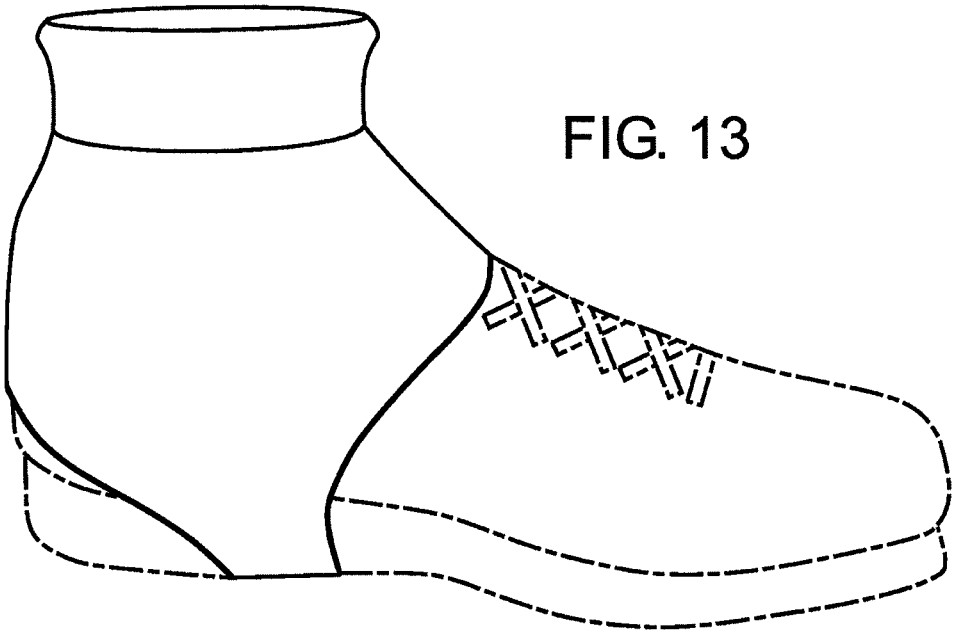
FIG. 13 is a side view of a debris inhibitor of the present invention while in use with an athletic shoe.

As seen in FIGS. 11-13, stirrup 240 covers the shoe around the arch of the shoe. This is achieved by the overall angles of cuts 222 and 232, which allow for the forward positioning of stirrup 240. When inhibitor 200 is pulled up over the shoe and ankle, this forward positioning of stirrup 240 focuses the stretch in the stirrup and front of inhibitor 200, and limits the stretching effect on heel-opening 246. This also helps prevent heel-opening 246 from rising up over the back of the shoe, while maintaining the necessary fit against the shoe to inhibit debris from entering the shoe.

Figure 7:
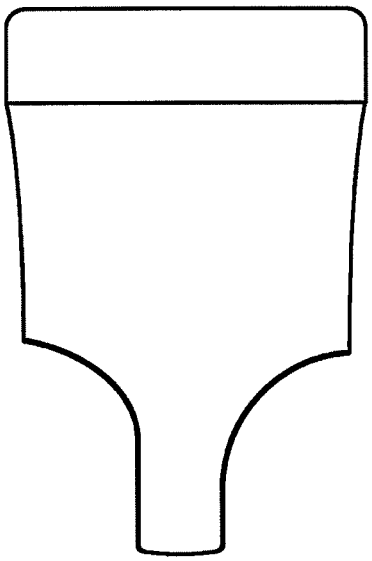
FIG. 7 is a side view of a debris inhibitor of the present invention.
Figure 8:
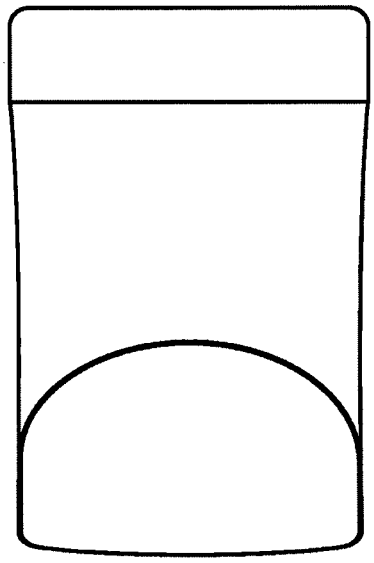
FIG. 8 is frontal view an expanded debris inhibitor of the present invention.
Figure 9:
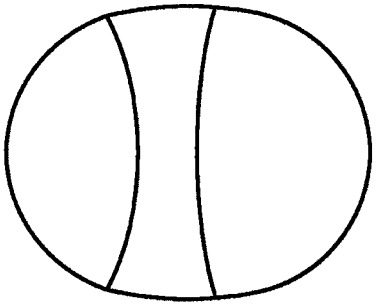
FIG. 9 is bottom view of an expanded debris inhibitor of the present invention.
Figure 10:
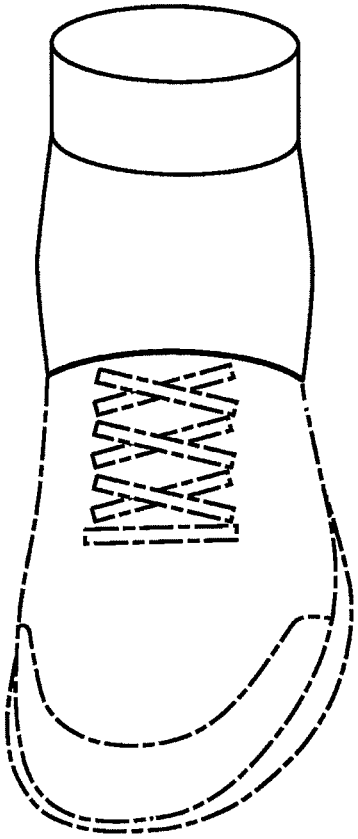
FIG. 10 is an angled frontal view of a debris inhibitor of the present invention while in use with an athletic shoe.

In certain embodiments, inhibitor 200 is shown in expanded form in FIGS. 7-9; a side view, a front view, and a top-down view, respectively. In certain other embodiments, inhibitor 200 is shown in use in FIGS. 11-13.

Inhibitor System

Figure 15:
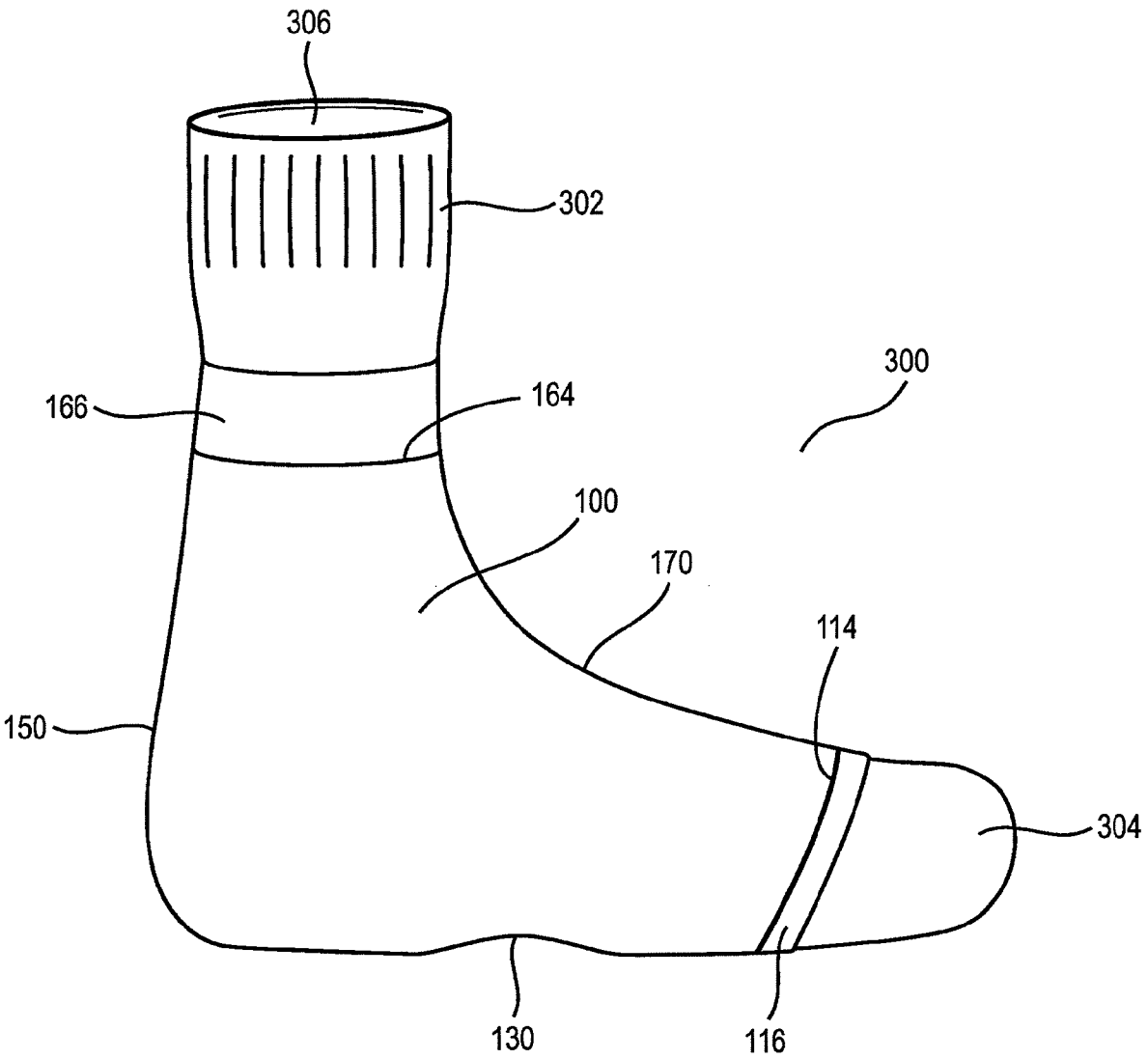
FIG. 15 is side view of an inhibitor system of the present invention with a sock component.

In another embodiment, inhibitor system 300 is shown in FIG. 15. Inhibitor system 300 is a combination of sock 302 and inhibitor 100, wherein sock 302 is attached to the internal side of inhibitor 100. Sock 302 is preferably attached about ankle-band 166. For example, sock 302 is attached about hem-line 164. Sock 302 can be of any material commercially used for athletics or outdoor purposes. Such materials are determined by the desired purpose of inhibitor system 300.

Sock 302 can extend beyond ankle-band 166 to any desired length. The top of sock 302 may also be flush or even with the top of ankle-band 166; however, sock 302 will remain attached about ankle-band 166 as described herein. Inhibitor system 300 is designed for the wearer to insert the foot through sock opening 306. Since sock 302 is attached about ankle-band 166, the wearer can roll inhibitor 100 up sock 302, allowing for the passage of the foot through sock 302, with the wearer's toes passing through sock 302 to end at toe portion 304. Sock 302 can then be inserted into an athletic shoe or outdoor shoe. Once the shoe is positioned and tied, the wearer can roll inhibitor 100 down over the shoe for a secure fit.

Figure 16:
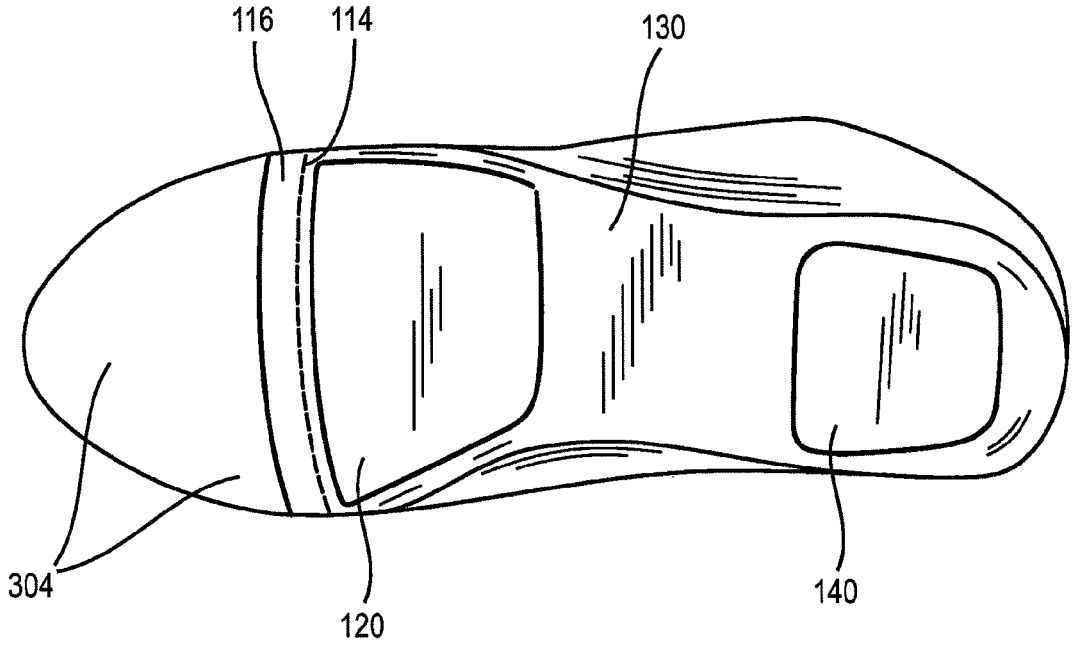
FIG. 16 is an angled bottom view of an inhibitor system of the present invention with a sock component.

FIG. 16 shows an angled bottom view of inhibitor system 300 as expanded. Cut 120 and cut 140 are shown in the expanded view, with the sock in view without the shoe on the foot. Toe portion 304 of the sock is shown extending beyond toe-band 116.

Figure 21:
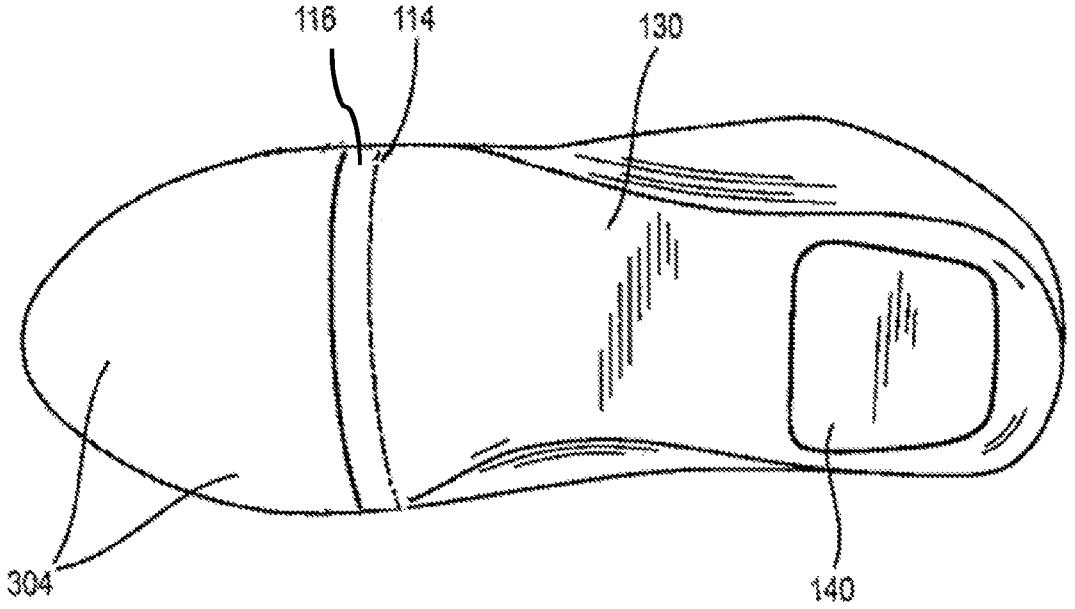
FIG. 21 shows an angled bottom view of an inhibitor system of the present invention with a sock component.

FIG. 21 shows an angled bottom view of inhibitor system 300 as expanded in another embodiment. Cut 140 is shown in the expanded view, with hem-line 114 and toe-band 116, and with the sock in view without the shoe on the foot. Toe portion 304 of the sock is shown extending beyond toe-band 116.

While the present invention is described above in detail and in reference to the drawings, it should be appreciated that the invention is not limited to the disclosed embodiments, and is intended to cover various modifications and equivalent arrangements included within the spirit and scope of the claims and specification. Modifications and variations in the present invention may be made without departing from the novel aspects of the invention as defined in the claims, and this application is limited only by the scope of the claims.

What is claimed is:

1. A method of manufacturing an over-the-shoe debris inhibitor from a tubular woven material comprising:

a. cutting a desired length of tubular woven material thereby forming a first raw cut and a second raw cut, wherein each raw cut is at opposite ends of the length of tubular woven material, and wherein the material is a fabric that can stretch; and b. making a straight cut proximal to the first raw cut, wherein the straight cut is at a depth less than the circumference of the tubular woven material, and wherein the straight cut forms an opening for passage of and conformity to a heel of the shoe and cleats located on the heel of the shoe, and wherein the straight cut keeps the debris inhibitor from stretching above a top portion of a back portion of the shoe;

wherein the method of manufacture produces an over-the-shoe debris inhibitor that covers an outside area of the shoe in use and inhibits debris from entering openings of the shoe.

2. The method of claim 1, further comprising folding and stitching the first raw cut to form a first hem.

3. The method of claim 2, further comprising adding material within the first hem to create a toe-band.

4. The method of claim 1, wherein the first raw cut and the first straight cut are separated by a bottom portion of the over-the-shoe debris inhibitor.

5. The method of claim 4, wherein the first straight cut is perpendicular to the bottom portion.

6. The method of claim 5, wherein the bottom portion fits between cleats on the front of a shoe and cleats on the heel of a shoe.

7. The method of claim 1, further comprising stitching the tubular woven material along the first straight cut to stabilize the tubular woven material along the first straight cut.

8. The method of claim 1, further comprising providing a seamless tube of the tubular woven material prior to the step (a).

9. An over-the-shoe debris inhibitor system comprising:

a. an over-the-shoe debris inhibitor made from the method of claim 1; and b. a sock, wherein the sock is attached to an internal surface of the over-the-shoe debris inhibitor of a).

10. A method for making the over-the-shoe debris inhibitor system of claim 9, comprising the steps of:

a. forming the over-the-shoe debris inhibitor of step a) in claim 9; and b. attaching a sock to the internal surface of the over-the-shoe debris inhibitor, wherein the sock is attached in a location that permits the sock to be worn over the foot and inserted into a shoe, and the over-the-shoe debris inhibitor be pulled down over the shoe.

* * * * *